United States Patent [19]

Austin et al.

[11] 4,131,805

[45] Dec. 26, 1978

[54] LINE POWER CORD ADAPTOR

[75] Inventors: James Austin, Shrewsbury; Daniel Clemson, Weston, both of Mass.

[73] Assignee: Data General Corporation, Westboro, Mass.

[21] Appl. No.: 827,920

[22] Filed: Aug. 26, 1977

[51] Int. Cl.[2] ..... H01R 13/50

[52] U.S. Cl. ..... 307/147; 339/32 R; 339/154 R

[58] Field of Search ..... 339/28, 31 M, 32 M, 339/31 R, 32 R, 195 A, 154 R, 154 A, 166 R; 307/147, 114, 80, 43

[56] References Cited

U.S. PATENT DOCUMENTS 2,450,657 10/1948 Guernsey ..... 339/31 M

*Primary Examiner*—Herman J. Hohauser

*Attorney, Agent, or Firm*—Joel Wall; Jacob Frank

[57] ABSTRACT

A line power cord voltage-magnitude adaptor is described herein. In a particular embodiment of the present invention, the power plug, line cord, and adaptor plug are pre-assembled as one component of the electrical equipment system; various voltage requirements can thus be prepared-for, whereby the equipment need not be altered, regardless of the eventual market for the equipment. The present invention can be used with virtually all kinds of electrical equipment energized by AC power, including computer systems.

9 Claims, 4 Drawing Figures

LINE POWER CORD ADAPTOR

BACKGROUND OF THE INVENTION

1. Field of the Invention

The present invention relates to improved electrical equipment systems and particularly to apparatus for automatically and simply adapting such systems for use with one of a plurality of line power magnitude availabilities.

2. Description of Prior Art

Some foreign countries have power requirements and specifications different from those in the United States. In certain countries of Europe, for example, power outputs of 220 volts and 240 volts at 50 cps (hertz) are available and widely used. In the United States, there are certain instances where similar voltage magnitudes (rms values) are used. Therefore, the electrical equipment used under these power conditions must be designed for such use.

In the prior art, "designing" for such use generally meant the employment of a suitable step-down (or step-up) transformer for the intended purpose. Alternatively, a general purpose transformer with multiple voltage-taps could be used, by hard wiring to the appropriate taps for the voltage selected. In either case, the prior art required working on the electrical equipment or on the AC Power input circuit in order to "tailor-make" the system to the particular power or voltage availability intended. Thus, some production efforts were necessarily directed to maintaining separate inventories, records, etc. of the variously tailored equipments. Elimination of this effort is a feature of the present invention.

SUMMARY OF THE INVENTION

The present invention relates to an electrical equipment system energized by AC line power having a magnitude selected from a plurality of predetermined magnitudes. Power is received by and conducted through a power cord to an adaptor plug. The adaptor plug connects to an AC input circuit of the system. The adaptor plug adapts the AC input circuit to operate with the magnitude of applied voltage without requiring any physical changes within the AC input circuit.

In a particular embodiment of the present invention, the adaptor plug includes electrical jumper connections, and the plurality of predetermined magnitudes of power include 100, 120, 220, and 240 volts rms.

Advantages in employing this invention include standardization of the electrical equipment being assembled. No special inventories need be kept for special voltage requirements.

It is thus a general object of the present invention to provide improved and more easily assembled apparatus and systems.

It is another object of the present invention to provide a scheme whereby an otherwise standardized electrical system can be connected to predetermined power source, where all of the adapting of the source to the electrical apparatus is automatically handled by an adaptor plug which is pre-wired for that particular power source in cooperation with an AC input circuit that is capable of being adjusted to properly receive the selected applied power by the mere interconnection thereof with the adaptor plug.

Other advantages and objects of the present invention will become apparent after referring to a detailed description of the preferred embodiment and to the appended drawings wherein:

DESCRIPTION OF THE PREFERRED EMBODIMENTS

Figure 1:
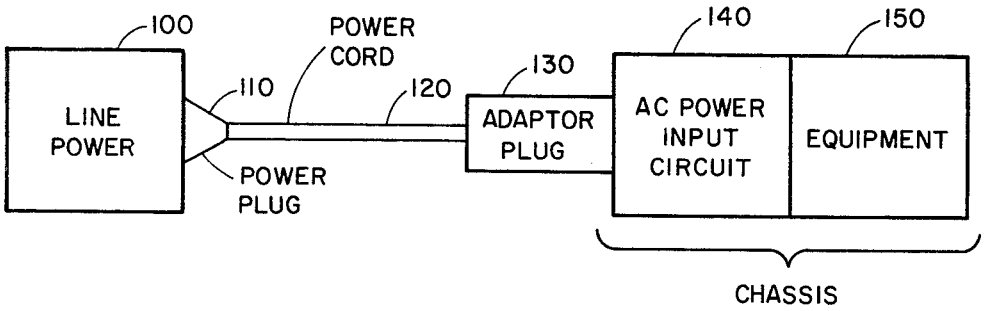
FIG. 1 is a block diagram of an electrical system in which the present invention is employed.

Referring to FIG. 1, a block diagram including the present invention is depicted. Line power 100 represents typical power available at the "wall socket", such as: 120 volts, 60 hertz; or 240 volts, 50 hertz; etc. Power plug 110, also shown in FIG. 2, connects from line power 100. Power cord 120, also shown in FIG. 2, connects from power plug 110, and typically contains three mutually insulated conductors (not shown), each conductor connecting respectively to one of the three electrical contacts shown.

Figure 2:
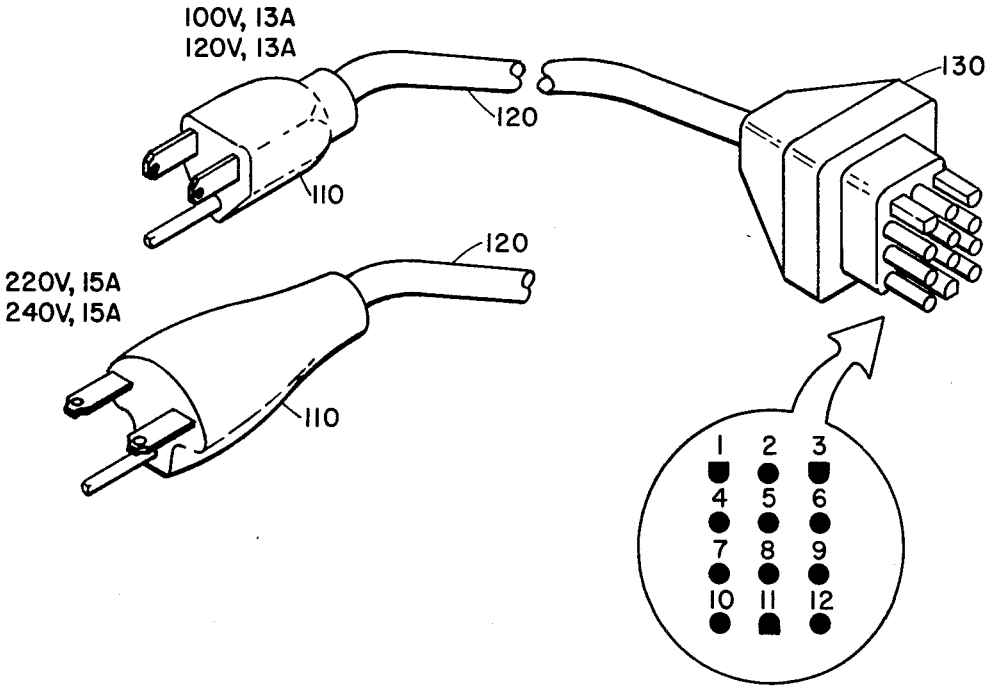
FIG. 2 is a perspective view of the power plug, line cord, and adaptor plug of FIG. 1.

Adaptor plug 130, shown in FIGS. 1 and 2, connects between power cord 120 and AC Power Input Circuit 140. Adaptor 130 includes 12 electrical conductor pins or jacks as shown in FIG. 2. These conductor pins are adaptable for being electrically-interconnected or "jumpered" within the housing of structure 130 into desired configurations to accomplish adaptability between the magnitude of the voltage or power source and AC Power Input Circuit 140.

Figure 3:
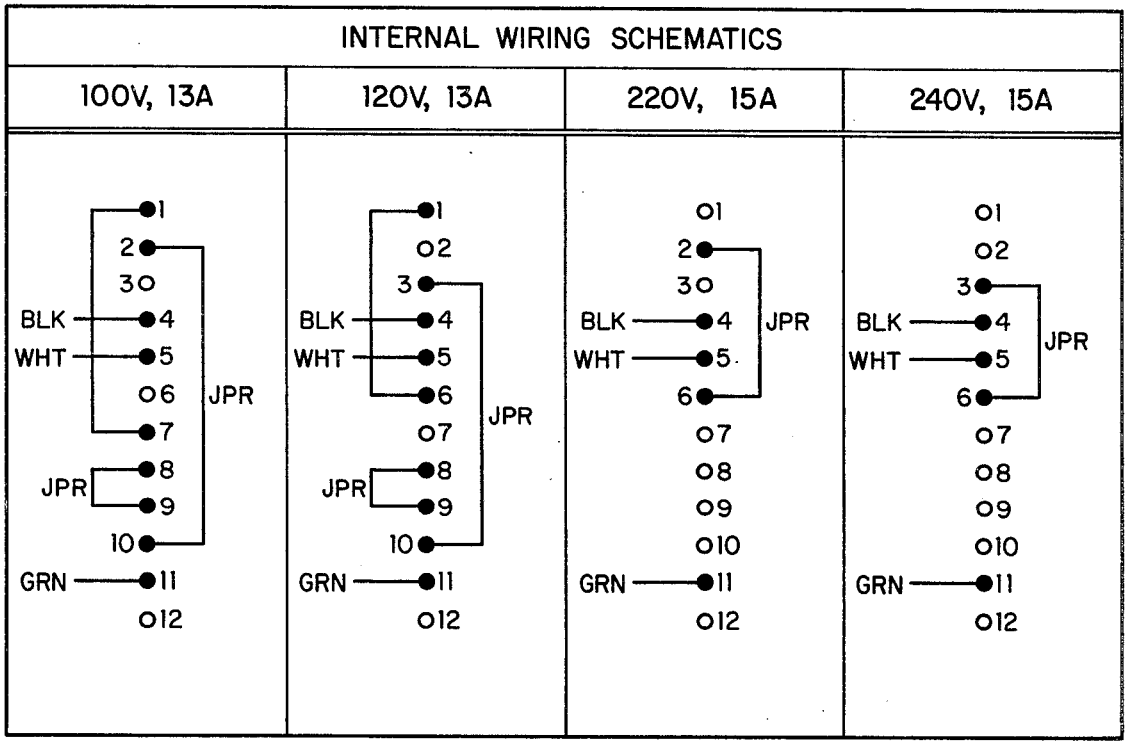
FIG. 3 is an internal wiring schematic of the jumper interconnections within the adaptor plug of FIG. 2, to adapt to the voltages indicated.

The interconnections or jumpers are shown in FIG. 3. In order to make circuit 140 (and thus equipment 150) work with 100 volts, terminals 1 and 7, 2 and 10, and 8 and 9 are interconnected; for 120 volts, terminals 1 and 6, 3 and 10, and 8 and 9 are interconnected; for 220 volts, 2 and 6 are interconnected; and, for 240 volts, 3 and 6 are interconnected. In all cases, the black conductor (ground) within line cord 120 connects to terminal 4; the white conductor (hot line) within line cord 120 connects to terminal 5; and the green conductor (chassis ground) within line cord 120 connects to terminal 11.

Figure 4:
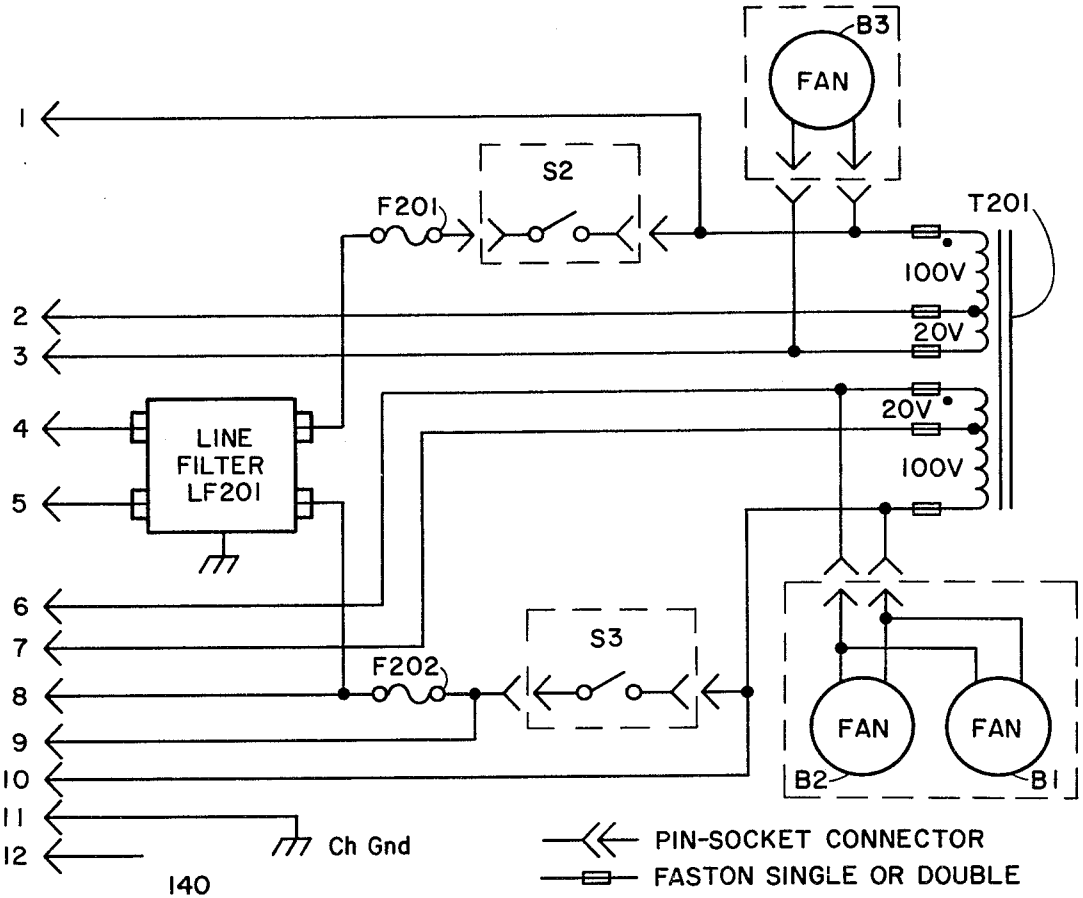
FIG. 4 is an electrical schematic of the AC power input circuit of FIG. 1.

Referring next to FIG. 4, the twelve mating connections to the above-noted 12 electrical conductor pins or jacks are shown. They are electrically interconnected with AC Input Circuit 140 as shown schematically in FIG. 4. Transformer primary T201 is shown, and the taps of this transformer are adjusted by adjusting the jumpers in structure 130; structure 140 need not be disturbed. For example, for 240 volt operation the transformer's primary coils are series connected by jumping terminals 3 and 6, and each of the two primary coils handles 120 volts. For 120 volt operation, the two transformer primary coils are connected in parallel, as can be seen when terminals 1 and 6 are connected, and terminals 3 and 10 are connected, and each primary coil then supports 120 volts.

Fans $B_1$, $B_2$, and $B_3$ are connected so they are always powered by 120 volts. Switches $S_2$ and $S_3$ are manually operable. Fuses F201 and F202 are both functionally included in the circuit when in 220 or 240 volt modes, but F202 is not functionally included in the circuit for the 100 or 120 volt modes. For the 100 or 120 volt modes, terminals 8 and 9 are connected together which shorts-out fuse F202. This is important since it ensures that a ground connection is maintained from terminal 5, through terminals 8 and 9, to the low voltage end of transformer primary T201 without a fuse path which otherwise could open and place the low voltage end of the transformer primary T201 at a dangerously high voltage. In fact it is an Underwriters Lab. requirement in the United States that no fuse in the ground path exist, for safety reasons. For 220$^{v}$ or 240$^{v}$ operation, both sides of the transformer primary are intentionally fused, since this is desirable for use in European countries where typically 110 or 120 volts either side of neutral is permitted.

Summarizing, the present invention contemplates a variety of prefabricated cable assemblies (110, 120 and 130); in the preferred embodiments, the line power voltages accommodated by the cable assemblies are 100, 120, 220, and 240 volts rms. This variety of cables thus permits identical apparatus (AC input circuits and their respective equipments, be they computer equipments or otherwise) to be manufactured. The appropriate cable assembly is then chosen to adapt the apparatus to any predetermined voltage magnitude.

Referring back to FIG. 2, two types of powerplug 110 configurations are shown, and are the configurations used in the United States for 110 volts and 220 volts, as noted in the figure. It should be understood that other power plug configurations can be employed. If, for example, some foreign country standardizes on some power plug configuration not known at the present time (triangular or hexagonal or some other geometrical cross section for its conductor pins), then that power plug can be employed within the prefabricated assembly (110, 120, and 130).

The invention may be embodied in yet other specific forms without departing from the spirit or essential characteristics thereof. Thus, the present embodiments are to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In an improved electrical equipment system energized by AC line power having a magnitude selected from at least three predetermined magnitudes, said power being received at a first end of a power cord by way of a power plug attached thereto and flowing therethrough to a second end of said cord, said cord containing no more than three mutually insulated conductors, said system including an AC power input circuit and electrical equipment powered by output from said circuit, the improvement comprising:

adaptor plug means connected between said second end of said power cord and input of said circuit for adapting said circuit to operate with said selected magnitude of line power without requiring any physical changes within said circuit.

2. In the improved system of claim 1 and wherein said adaptor plug means, said cord, and said power plug are assembled together as one component of said system for use with said selected magnitude of line power, whereby said circuit and said equipment of said system can be assembled without other variation in assembly which would otherwise occur due to choice of said selected magnitude of line power.

3. The improvement of claim 1 and wherein said at least three of predetermined magnitudes includes 100 volts, 120 volts, 220 volts, and 240 volts.

4. The improvement of claim 3 and wherein said circuit includes means for fusing said equipment, said adaptor plug means including means for eliminating operation of said fusing means when said predetermined magnitudes are 100 volts and 120 volts.

5. The improvement of claim 1 and wherein said circuit includes a multiple-tap transformer, the operation of said adaptor means effectively selecting certain of said taps of said transformer.

6. The improvement of claim 1 and wherein said equipment is digital computer equipment.

7. The improvement of claim 1 and wherein said adaptor plug means contains electrical jumper connections.

8. An electrical system energized by AC power having a magnitude selected from at least three predetermined power magnitudes, said system comprising:

a power cord having no more than three mutually insulated conductors;

power plug means being appropriately configured for receiving said power having said selected magnitude at a first end of said cord;

an AC power input circuit;

adaptor plug means connected between the other end of said cord and the input of said AC power input circuit for adapting said circuit to operate with said selected power magnitude without requiring physical changes within said circuit;

said appropriately-configured power plug, said power cord and said adaptor plug means all being pre-assembled to form one component of said system; and electrical equipment powered by output of said AC power input circuit.

9. The system of claim 8 and wherein said component is one of at least three components corresponding respectively to one of said at least three predetermined power magnitudes, whereby said equipment and said AC power input circuit are capable of being powered from any one of said at least three predetermined power magnitudes by connection therewith to said corresponding one of said at least three components.

* * * * *